United States Patent [19]

Hayashida et al.

[11] Patent Number: 4,650,310

[45] Date of Patent: Mar. 17, 1987

[54] TONER DENSITY DETECTING DEVICE

[75] Inventors: Masatoshi Hayashida, Kawasaki; Takayuki Suga, Tokyo; Hiroshi Yamanaka, Kawasaki, all of Japan

[73] Assignee: Kabushiki Kaisha Toshiba, Kawasaki, Japan

[21] Appl. No.: 726,999

[22] Filed: Apr. 25, 1985

[30] Foreign Application Priority Data

Apr. 27, 1984 [JP] Japan ..... 59-83926

[51] Int. Cl.[4] ..... G03G 15/09

[52] U.S. Cl. ..... 355/3 DD; 355/14 D; 118/689; 336/90

[58] Field of Search ..... 355/3 DD, 14 D; 118/688, 689, 690, 691; 324/204, 219; 73/32 R; 336/90

[56] References Cited

U.S. PATENT DOCUMENTS 3,611,280 10/1971 Sheehy ..... 367/191
3,825,886 7/1974 Thigpen ..... 367/177
3,872,824 3/1975 Erney et al. ..... 118/7
3,962,992 6/1976 Takagi et al. ..... 118/637
4,147,127 4/1979 Terashima ..... 118/646
4,174,902 11/1979 Hamaguchi ..... 355/3

*Primary Examiner*—A. T. Grimley
*Assistant Examiner*—J. Pendegrass
*Attorney, Agent, or Firm*—Schwartz, Jeffery, Schwaab, Mack, Blumenthal & Evans

[57] ABSTRACT

A toner density detecting device is provided with a coil buried in a housing and a cover member provided on one end of the coil to prevent the developing agent from touching the coil. The cover member has a front end portion provided near the surface of the housing and extending along the developing agent flowing direction and an apex portion at the back of the front end portion with respect to the direction. The apex portion projects deeper into the developing agent than the front end portion. An edge connecting the front end portion and the apex portion extends in the direction to cross the central axis of the coil. A pair of faces extending in the direction on either side of the edge are gradually declined from the edge toward the surface of the housing.

15 Claims, 16 Drawing Figures

TONER DENSITY DETECTING DEVICE

BACKGROUND OF THE INVENTION

The present invention relates to a toner density detecting device for regularly controlling the toner density of a two-component developing agent used in a developing apparatus of an electronic copying machine or the like, and more specifically to a toner density detecting device for detecting a change in carrier density as a change of permeability and calculating the toner density on the basis of the carrier density.

FIG. 1 shows a prior art toner density detecting device 1. In FIG. 1, numeral 2 designates a developing device used in an electronic copying machine, 3 a magnet roller for carrying a developing agent in the developing device 2 and developing a charged pattern on a photoconductive drum 4, 5 a separating plate for clearing the magnet roller 3 of that portion of the developing agent returned to the developing device 2 without having been used in developing. The toner density detecting device 1 is provided with a detecting coil 6 as a detecting portion. In the developing device 2 constructed in this manner, a cover member 7 covering the detecting coil 6 is disposed so that the end face (hereinafter referred to also as head face) is in contact with the developing agent carried in a mobile manner on the magnet roller 3. The toner density is detected by measuring the inductance of the detecting coil 6 which depends on the permeability of the carrier of the developing agent.

An essential point here is the flowing condition of the developing agent touched by the head face. The permeability of the carrier of the developing agent in contact with the head face will change if the flow of the developing agent near the head face becomes uneven. In order to accurately measure the change of the carrier density of the developing agent as a change of permeability, therefore, it is necessary that the flow of the developing agent on the head face be uniform.

In the prior art toner density detecting device, however, the head face (end face of the cover member 6) is flat in shape, as shown in FIGS. 2A to 2C. Therefore, the developing agent is liable to flow unevenly, clogging the passage between the head face and the magnetic roller 3, as shown in FIG. 1. Thus, in measuring the inductance of the detecting coil 5, high-frequency noises may be produced to complicate accurate toner density measurement. FIG. 3 shows fluctuations in data on the measurement of the inductance.

SUMMARY OF THE INVENTION

The present invention is constructed in consideration of these circumstances, and is intended to provide a toner density detecting device, simple in construction and capable of keeping the flow of a developing agent along the head face of a detecting coil uniform, and of invariably detecting accurate toner density.

In order to achieve the above object of the present invention, a head face in contact with a developing agent in a flowing state, that is, the surface of a cover member covering a detecting coil, is declined from its portion near the central axis of the detecting coil in a direction perpendicular to the flowing direction of the developing agent so that the central portion of the cover member projects into the flowing developing agent.

DETAILED DESCRIPTION OF THE PREFERRED EMBODIMENTS

Figure 5A:
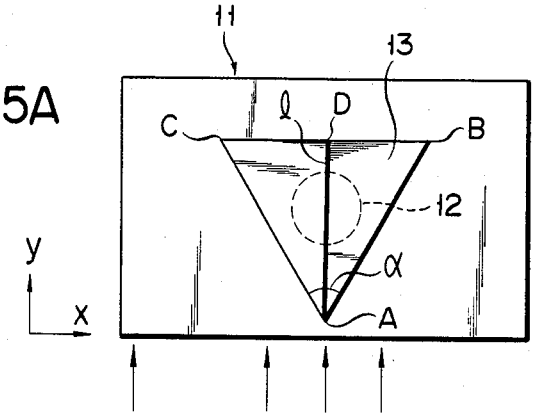
FIGS. 5A, 5B and 5C are top, side and front views, respectively, of a head portion shown in FIG. 4.
Figure 5B:
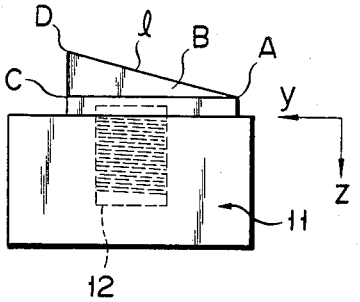
Figure 5C:
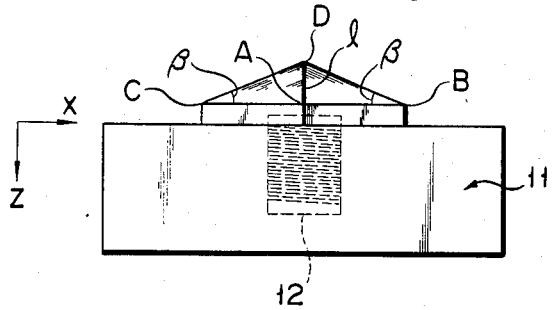
Figure 6:
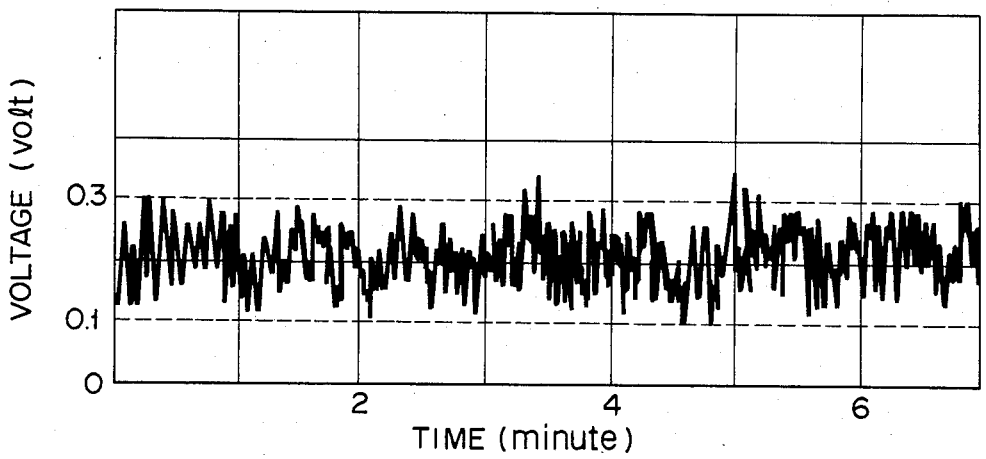
FIG. 6 is a diagram showing fluctuations of inductance in the first embodiment.

A first embodiment of a toner density detecting device according to the present invention will now be described in detail with reference to the accompanying drawings of FIGS. 4 to 6.

Figure 4:
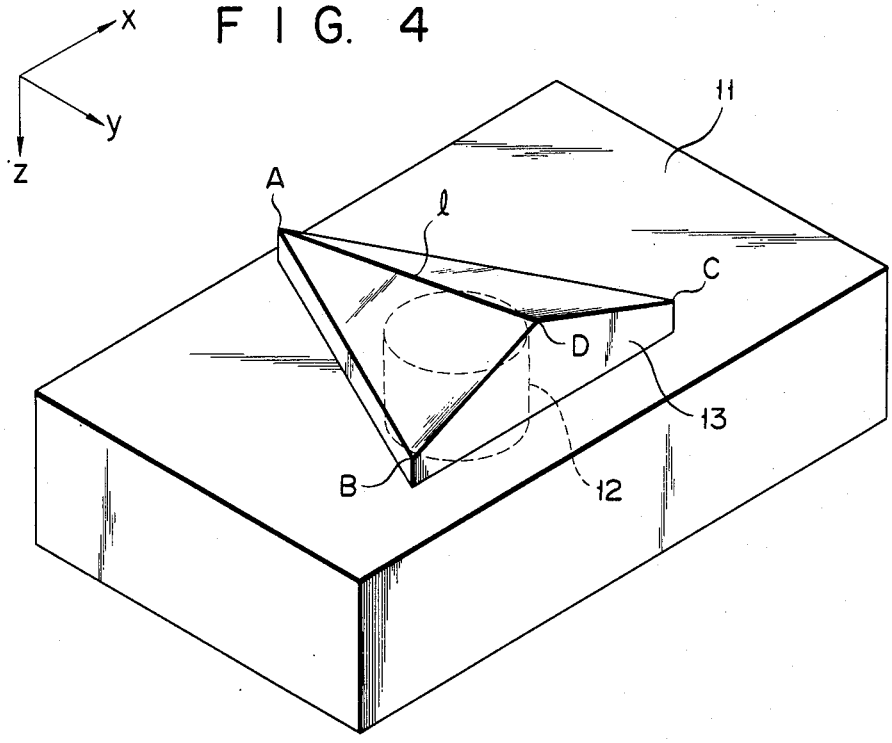
FIG. 4 is a perspective view showing a first embodiment of a toner density detecting device according to the present invention.

FIG. 4 is a perspective view of the first embodiment of the invention. FIG. 5A is a top view along plane x–y of FIG. 4, FIG. 5B is a side view along plane y–z taken in the direction of the x-axis of FIG. 4, and FIG. 5C is a front view along plane x–z taken in the direction of the y-axis of FIG. 4.

In FIG. 4, numeral 11 designates a housing of the toner density detecting device. The housing 11 contains therein a detecting coil 12 for detecting the toner density as a change of permeability. A detecting end of the detecting coil 12 projects from the surface of the housing 11. The central axis (longitudinal axis) of the detecting coil 12 extends along the z-axis, while a developing agent flows in the direction of the y-axis. The detecting end of the detecting coil 12 is covered with a plastic cover member 13.

The cover member 13 is shaped as follows. In the plan view of FIG. 5A along plane x–y perpendicular to the central axis (z-axis) of the detecting coil 12, the cover member 13 is shaped like an isosceles triangle ABC whose apex A is on the upper-course side with respect to the direction of the y-axis or the flowing direction of the developing agent, and whose base BC extends along the x-axis. In the side view of FIG. 5B along plane y–z taken in the x-axis direction (perpendicular to the y-axis direction in which the developing agent flows), the cover member 13 is shaped like a right-angled triangle DAC with the base AC vertical side DC and hypotenuse DA (edge l) at an angle $\alpha$ to the base AC or horizontal line. The point B is not seen in the x-section of FIG. 5B but is indicated in phantom. However, a section viewed from the opposite would show a triangle DAB with base AC and vertical side DC. In the front view of FIG. 5C along plane x–z taken in the y-axis direction (parallel to the flowing direction of the developing agent), the cover member 13 has the shape of an isosceles triangle DCB with the apex D, base BC, and base angle $\beta$.

Thus, the cover member 13 is formed of a triangular pyramid which has the apex D projecting into the passage of the developing agent, an edge l (hypotenuse DA) extending in the y-axis direction along which the developing agent flows, two slopes (faces ADB and ADC) declined from the edge l toward the surface of the housing 11, and a perpendicular face DBC. In other words, the cover member 13, in its three-dimensional configuration, is shaped like a triangular pyramid which has the base ABC, the two faces ADB and ADC inclined at an angle to the base ABC, and the perpendicular face DBC. Thus, any section of the cover member 13 taken along plane x-z perpendicular to the flowing direction of the developing agent is in the shape of an isosceles triangle with the base angle $\beta$.

The toner density detecting device 11, constructed in this manner, is disposed in a developing apparatus of a copying machine or the like so that the cover member 13 is oriented properly with respect to the flow of the developing agent. More specifically, the toner density detecting device 11 is positioned so that the perpendicular from the apex A to the base BC of the triangle, constituting one face of the cover member 13, is parallel to the y-axis direction in which the developing agent flows. Thus, the cover member 13 of this embodiment is in the form of a triangular pyramid having the two faces ADB and ADC which are inclined at an angle equivalent to the base angle $\beta$ from the edge l passing through the central axis of the detecting coil 13 in the direction perpendicular to the y-axis direction in which the developing agent flows.

Disposed in the developing apparatus in this manner, the toner density detecting device 11 detects the carrier density of the developing agent in the developing apparatus by measuring the inductance of the detecting coil 12 which depends on the permeability of the developing agent. The inductance of the detecting coil 12 is determined by measuring the terminal voltage of the coil 12. This measurement can be accomplished by the use of conventional means, such as changes of allotted voltages of the detecting coil 12 and a voltage divider circuit formed of a resistor. Therefore, the method of measurement will not be described in detail herein.

There will now be described the operation and effects of the toner density detecting device 11 with the aforementioned construction which is positioned in the same manner as the prior art toner density detecting device in the developing apparatus in FIG. 1.

Figure 1:
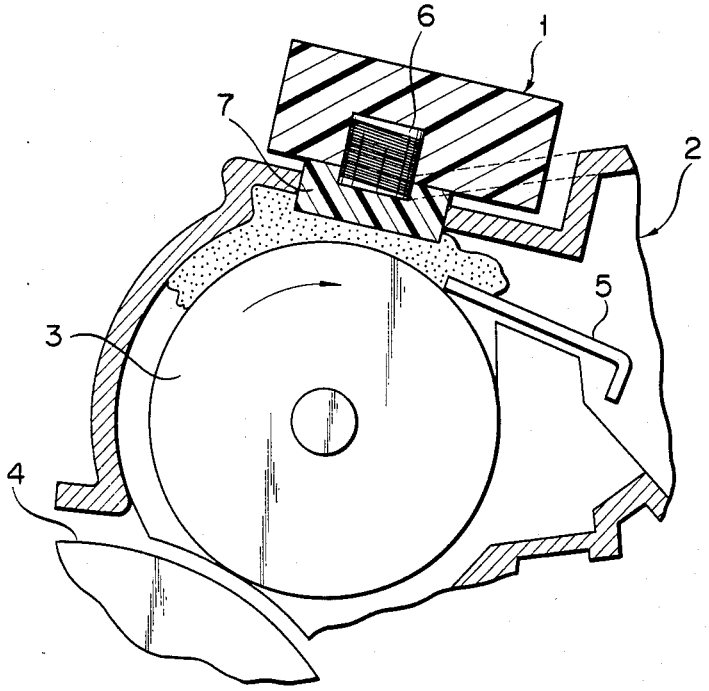
FIG. 1 PRIOR ART
FIG. 1 is a sectional view showing a prior art developing apparatus.
Figure 2A:
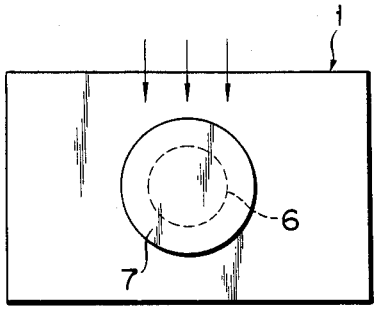
FIG. 2A PRIOR ART
FIGS. 2A, 2B and 2C are partially enlarged views showing an example of a toner density detecting device used in the developing apparatus of FIG. 1.
Figure 2B:
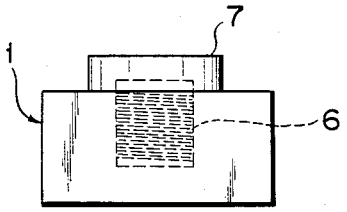
FIG. 2B PRIOR ART
Figure 2C:
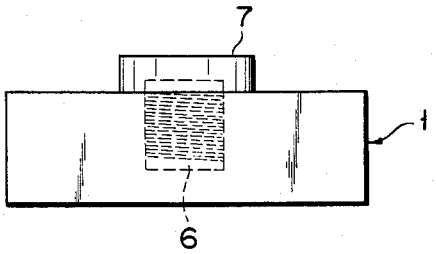
FIG. 2C PRIOR ART
Figure 3:
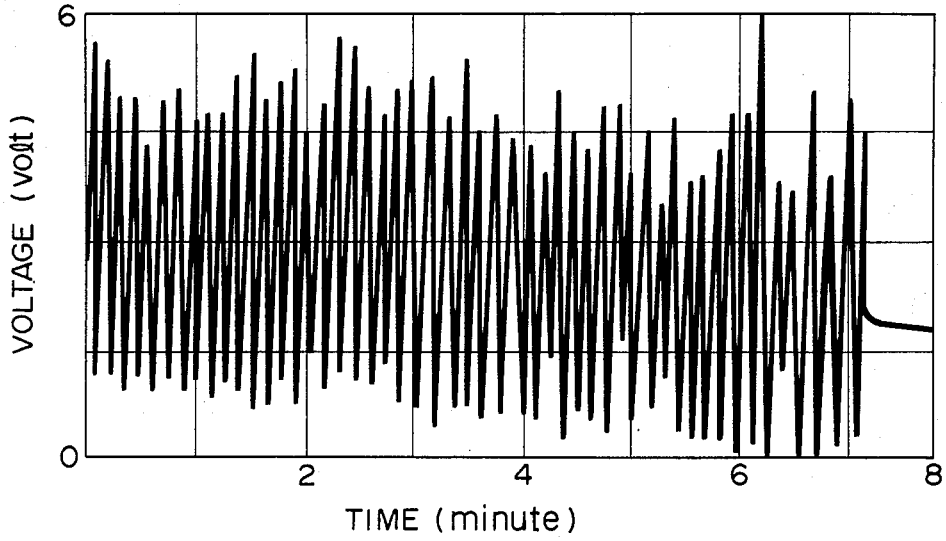
FIG. 3 PRIOR ART
FIG. 3 is a diagram showing fluctuations of inductance in the prior art device shown in FIGS. 2A to 2C.

In FIG. 1, the magnet roller 3 rotates and carries the developing agent attracted thereto, thereby developing an electrostatic latent image formed on the photoconductive drum 4. During the developing operation, toner in the developing agent on the surface of the magnet roller 3 is consumed, so that the toner density of the developing agent is lowered. As the magnet roller 3 is further rotated, the developing agent with the reduced toner density is fed forward, flowing between the magnet roller 3 and the head face of the toner density detecting device 11. As a result, the inductance of the detecting coil 12 changes, influenced by a change of the permeability of the carrier of the developing agent. Thus, the carrier density of the developing agent is measured, directly. So far as the detecting surface of the detecting coil 12 is concerned, if the toner is consumed to lower the toner density, then the carrier density will be increased in proportion. Thus, the toner density is measured on the basis of the carrier density detected within the detecting surface.

During this measurement, the developing agent is kept in a uniform flowing state, without it stagnating or clogging, owing to the aforesaid shape of the head face. Accordingly, the permeability of the developing agent flowing between the magnet roller 3 and the head face changes exactly in proportion to the carrier density of the developing agent. Thus, the inductance of the detecting coil 12, which is influenced by the permeability, can stably be measured, as indicated by fluctuations of data in FIG. 6.

The head face of the head 13 projecting into the flow of the developing agent guides the flowing developing agent on its two surface portions (faces ADB and ADC) inclined with respect to the flowing direction (y-axis direction) of the developing agent, distributing the developing agent on either side of the central axis of the detecting coil 12 or the edge l. Thus, the head 13 acts like the bow of a stationary ship receiving flowing water. With the head face of the head 13 shaped in this manner, the developing agent can smoothly flow along the head face without stagnation.

Here the angle 62 constituting the shape of the head face is an important factor. By selecting the angle $\beta$ within a range from 1 degree to less than 90 degrees, that is, by shaping the head face so that the apex D projects from the plane ABC into the developing agent, the flow of the developing agent can be kept uniform, permitting stable measurement of the inductance of the detecting coil 12.

The angles DAB and CAB are suitably selected in accordance with the flowing condition of the developing agent, that is, so as not to check the flow.

Although an illustrative embodiment of the present invention has been described in detail herein, it is to be understood that the invention is not limited to the arrangement of the first embodiment, and that various changes and modifications may be effected therein by one skilled in the art without departing from the scope or spirit of the invention.

Figure 7A:
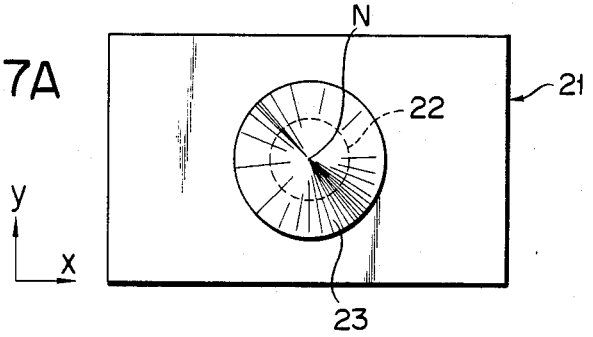
FIGS. 7A, 7B and 7C are top, side and front views, respectively, showing a second embodiment of the toner density detecting device according to the present invention.
Figure 7B:
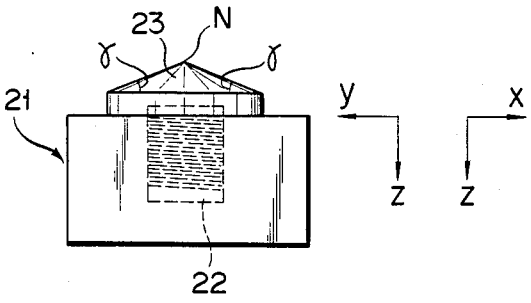
Figure 7C:
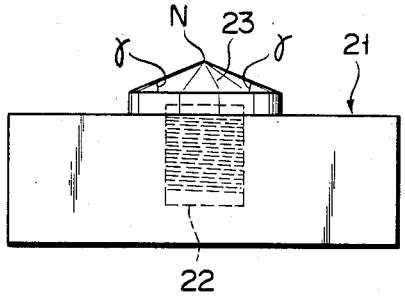

Referring now to FIGS. 7A, 7B and 7C, a second embodiment of the present invention will be described.

In the first embodiment described above, the head 13 is shaped so that its section is invariably in the form of an isosceles triangle when taken along a plane perpendicular to the flowing direction of the developing agent (y-axis direction). However, those portions of the section corresponding to the legs of the isosceles triangle may each be formed of a curved line instead of a straight line. In FIGS. 7A to 7C showing the second embodiment constructed in this manner, numeral 21 designates a housing of the toner density detecting device, 22 a detecting coil, and 23 a plastic cover forming a head face. In this second embodiment, the cover member 23 is in the form of a cone in which the perpendicular from the apex N to the base is in alignment with the central axis of the detecting coil 22 and its slant and base form a predetermined angle $\gamma$ between them. The angle $\gamma$ corresponds to the angle $\beta$ in the first embodiment, ranging from 1 degree to less than 90 degrees.

In the second embodiment constructed in this manner, as in the first embodiment, the flow of the developing agent can be kept uniform, and the inductance of the detecting coil 22 can be measured with stability.

In the first and second embodiments, the heads 13 and 23 are described as having a pointed apex. More specifically, the head 13 of the first embodiment has the shape of a triangular pyramid, and the head 23 of the second embodiment of a cone. Alternatively, however, the present invention may be constructed as shown in FIGS. 8A, 8B and 8C for a third embodiment.

Figure 8A:
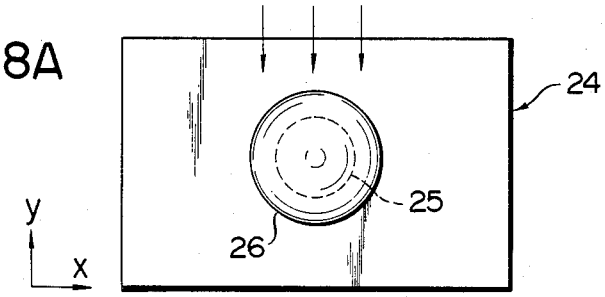
FIGS. 8A, 8B and 8C are top, side and front views, respectively, showing a third embodiment of the toner density detecting device according to the present invention.
Figure 8B:
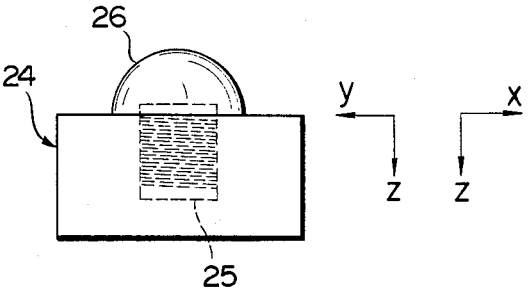
Figure 8C:
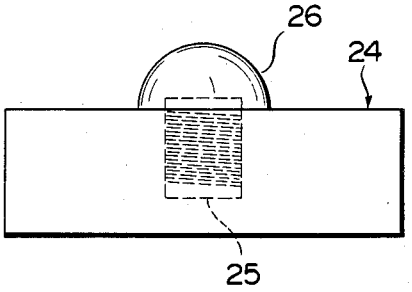

In FIGS. 8A to 8C, numeral 24 designates a housing of the toner density detecting device, 25 a detecting coil, and 26 a plastic head forming a head face. In this third embodiment, the head 26 is in the form of a hemisphere such that the perpendicular from the apex O to the base is in alignment with the central axis of the developing coil 25. With this configuration of the head 26, the edge or slant connecting the front end portion and apex of the head 26 is formed of a curved line. In both the first and second embodiments, in contrast with this, the edge is formed of a straight line. Thus, the present invention may provide prescribed effects without regard to the shape of the edge.

What is claimed is:

1. A toner density detecting device which detects the toner density of a developing agent by measuring the inductance of a coil determined by the permeability of the carrier of the developing agent, comprising:

a housing having a surface extending along the flow of the developing agent in one direction;

the coil buried in the housing, one end of said coil being exposed from the surface of the housing to be located in the developing agent; and a cover member provided on said one end of the coil to prevent the developing agent from touching the coil, said cover member having a front end portion provided near the surface of the housing and extending along said one direction and an apex portion at the back of the front end portion with respect to said one direction and projecting deeper into the developing agent than the front end portion, so that an edge connecting the front end portion and the apex portion extends in said one direction to cross the central axis of the coil, and that a pair of faces extending in said one direction on either side of the edge are gradually declined from the edge toward the surface of the housing.

2. The toner density detecting device according to claim 1, wherein said edge is formed of a straight line.

3. The toner density detecting device according to claim 2, wherein said pair of faces are each formed of a flat surface.

4. The toner density detecting device according to claim 3, wherein said cover member is in the form of a triangular pyramid.

5. A toner density detecting device for detecting toner density of a developing agent by measuring the inductance of a coil as determined by the permeablility of a carrier of the developing agent, comprising:

a housing having a surface extending along a flow direction of the developing agent;

a coil disposed in said housing, one end of said coil being exposed from a surface of said housing; and a cover means provided on said one end of said coil for preventing the developing agent from touching the coil, said cover means having a highest portion extending into said developing agent, said cover means having portions varying away from said highest portion in a direction facing said developing agent flow and in directions perpendicular to said developing agent flow.

6. The toner density detecting device of claim 5, wherein said varying portions comprise a curved surface.

7. The toner density detecting device of claim 6, further comprising a magnetic means for carrying the developing agent in contact with said cover means, and wherein said coil means comprises a means for measuring a permeability of said magnetic means.

8. The toner density detecting device of claim 6, wherein said portions varying away from said highest portion in directions perpendicular to said developing agent flow comprise planar surfaces.

9. The toner density detecting device of claim 8, wherein said portions comprise a substantially cone shaped formation,

10. The toner density detecting device according to claim 6, wherein said portions varying away from said highest portions are nonlinearly downwardly inclined.

11. The toner density detecting device according to claim 10, wherein said portions comprise a substantially hemispherical formation.

12. The toner density detecting device of claim 5, wherein said portions comprise a triangular pyramid.

13. A toner density detecting device for detecting toner density of a developing agent by measuring an inductance of a coil as determined by the permeability of a carrier of the developing agent, comprising:

a housing having a surface extending along a flow direction of the developing agent;

a coil disposed in said housing, one end of said coil being exposed from a surface of said housing;

a cover means provided on said one end of said coil for preventing the developing agent from touching the coil, said cover member comprising:

an elevated front end portion provided in a plane substantially perpendicular to said one direction;

an apex portion displaced from said front end portion along said one direction and projecting deeper into the developing agent than the front end portion, whereby a line connecting said front end portion and said apex portion extends in said one direction across a central axis coil; and a pair of faces disposed on both sides of said line, said faces being gradually inclined downwardly toward the surface of the housing.

14. The toner density detecting device according to claim 13, wherein said pair of faces are each formed of a flat surface.

15. The toner density detecting device according to claim 14, wherein said cover member is in the form of a triangular pyramid.

* * * * *